US005380562A

United States Patent [19]

Hattori et al.

[11] Patent Number: 5,380,562

[45] Date of Patent: Jan. 10, 1995

[54] PROCESS FOR ELECTROLESS GOLD PLATING

[75] Inventors: Noriko Hattori, Higashiosaka; Eiichi Torikai, Yao; Shigemitsu Kawagishi, Suita; Mitsuaki Tadakoshi, Osaka; Kazuyoshi Okuno, Ashiya, all of Japan

[73] Assignee: Okuno Chemical Industries Co., Ltd., Japan

[21] Appl. No.: 128,156

[22] Filed: Sep. 29, 1993

Related U.S. Application Data

[63] Continuation of Ser. No. 840,088, Feb. 24, 1992, abandoned.

[30] Foreign Application Priority Data

Feb. 22, 1991 [JP] Japan ..... 3-114158
Dec. 6, 1991 [JP] Japan ..... 3-323031

[51] Int. Cl.[6] ..... C23C 26/00

[52] U.S. Cl. ..... 427/437; 427/304; 427/443.1

[58] Field of Search ..... 427/304, 305, 306, 437, 427/443.1

[56] References Cited

U.S. PATENT DOCUMENTS

| | | | |
|---|---|---|---|
| 3,468,676 | 9/1969 | Schneble | 427/437 |
| 3,700,469 | 10/1972 | Okinaka | 427/437 |
| 4,005,229 | 1/1977 | Miller | 427/304 |
| 4,082,908 | 4/1978 | Vanaglash | 427/437 |
| 4,307,136 | 12/1981 | Prost-Tournier | 427/437 |
| 4,337,091 | 6/1982 | El-Shazly | 427/443.1 |
| 4,792,469 | 12/1988 | Saito | 427/437 |
| 4,978,559 | 12/1990 | Iacovangelo | 427/304 |
| 4,979,988 | 12/1990 | Iacovangelo | 427/304 |
| 4,985,076 | 1/1991 | Iacovangelo | 427/304 |
| 5,035,744 | 7/1991 | Nishiyama | 427/304 |

FOREIGN PATENT DOCUMENTS

| | | | |
|---|---|---|---|
| 2121444 | 12/1983 | United Kingdom | 427/304 |

*Primary Examiner*—Michael Lusignan
*Assistant Examiner*—Vi Duong Dang
*Attorney, Agent, or Firm*—Larson and Taylor

[57] ABSTRACT

A process for electroless gold plating using plating solution comprizing cyanoaurate, alkaline cyanide, reducing agent, alkaline hydroxide, crystal condition controlling agent and stabilizer characterized in that an aldehyde or a ketone compound is added together with replenished gold salt, and hydrogen peroxide is also added, if necessary.

10 Claims, 1 Drawing Sheet

PROCESS FOR ELECTROLESS GOLD PLATING

This application is a continuation of application Ser. No. 07/840,088 filed Feb. 24, 1992 now abandoned.

FIELD OF INDUSTRIAL APPLICATION

This invention relates to a process for electroless gold plating capable of continuous use of plating solution.

DISCLOSURE OF THE INVENTION

Electroless gold plating is requested not only to improve properties of gold film deposited, such as adhesion to a substrate and a bonding property but also to have properties, such as high stability of plating solution, short plating time and an excellent continuous operating property, and the development of electroless gold plating solution to satisfy the above conditions have been earnestly desired.

A basic composition of autocatalytic electroless plating solution frequently used at present is composed of compounds, such as gold cyanide salt, alkaline cyanide, alkaline hydroxide and the like, and borohydride compounds or water soluble alkylaminoboran added as a reducing agent. However, it is extremely difficulty for the composition to satisfy the requested workability and the quality control as mentioned above. Various methods to improve a plating solution have been attempted, for example, tried were the addition of stabilizers, such as carboxylic acid salts, amino compounds, alcohols and various chelating agents and the addition of crystal growth controlling agents, such as Tl, Pb, As and the like.

When the composition of the plating solution with the additives changes as the progress of plating, the rapid alteration of not only properties of plating film but also deposition rate and stability of plating film are often made. Therefore, the attempt to add the additives to a plating solution is not suitable enough for continuous plating operation desired in the field of electronics.

Further, to a plating solution is generally added free cyanide ion (CN—) as a basic component to stabilize the plating solution, and the increase of the amount of free cyanide ion causes a great change of quality of film and decrease of plating rate. Gold cyanide salt is used to replenish gold so that the concentration of free cyanide ion increases as deposition of gold film, and the concentration of cyanide ion in plating solution cumulatively increases. Consequently, the plating rate is decreased due to an excessive amount of free cyanide ion. To avoid the increase of cyanide ion concentration and deposit plating film in a predetermined rate, considered methods are frequent change of plating solution under controlling the composition of plating solution and replenishment of cyanide ion-free compounds, such as gold oxide gold hydroxide, gold chloride, imide compounds etc. However, the methods are not practical, because frequent change of plating solution is troublesome, the solubility of gold oxide being poor, chloride ion and imide compound etc. having a great influence on deposition film.

Figure 1:
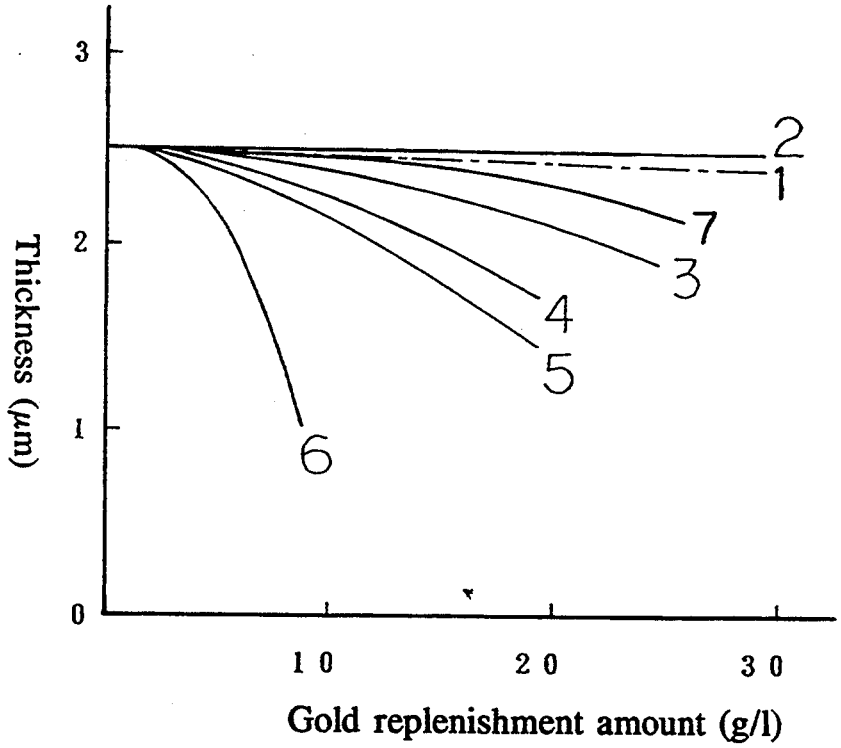
FIG. 1 shows the alteration of plating deposition rate under the continuous use of plating solutions.

The inventors have conducted research on how to decompose or suppress excessive free cyanide ion cumulating as replenishment of gold cyanide salt to electroless gold plating solution without damaging capability of the solution. During the subsequent research, we find that the addition of an aldehyde or a ketone compound with repleshing gold salt effectively achieves the object mentioned above.

The present invention provides a process for electroless plating using plating solution comprising gold cyanide salt, alkaline cyanide, reducing agent, alkaline hydroxide, crystal growth controlling agent and stabilizer characterized in that an aldehyde or a ketone compound was added with replenishment of gold salt.

In the invention, hydrogen peroxide is preferably added with an aldehyde or a ketone compound.

As constituents of the plating solution used in the invention, dicyanoaurate(I) salts, such as potassium dicyanoaurate(I) and sodium dicyanoaurate(I), tetracyanoaurate(III) salts, such as potassium tetracyanoaurate(III), sodium tetracyanoaurate(III) are mainly exemplified as aurate, and other gold compounds having different ligands or counter ions, such as gold oxide, gold hydroxide, chloroaurate(tetrachloroaurate(III)) and alkali matal salt or ammonium salt thereof can be used. Gold ion concentration in the plating solution is in the range of 0.5 to 20 g/l, preferably 1 to 5 g/l as metal weight.

Alkali matal cyanides, such as potassium cyanide, sodium cyanide are exemplified as an alkaline cyanide. The alkaline cyanide is used in a concentration in the range of about 0.5 to about 20 g/l, preferably about 0.5 to about 5 g/l.

Alkali metal borohydrides, alkylaminoborane and the like are used as a reducing agent, alkylaminoborane being preferable to prepare a more stable plating solution. Sodium borohydride, lithium borohydride, potassium borohydride and the like are exemplified as the alkali matal borohydrides, dimethylaminoborane(DMAB), diethylaminoborane, trimethylaminoborane, triethylaminoborane and the like being exemplified as the alkylaminoborane. The reducing agent mentioned above can be used simply or in a mixture of at least two agents thereof. The reducing agent can be used in a concentration in the range of about 1 to about 50 g/l, preferably about 2 to about 25 g/l. Sodium hydroxide, potassium hydroxide, lithium hydroxide and the like can be used as an alkaline hydroxide, they being added in an amount needed to maintain the pH value of the plating solution over 13.

Metal compounds such as lead, thallium, arsenic and the like, more detailedly, lead nitrate, lead oxide, lead acetate, ethylenediaminetetraacetic acid lead salt (Pb-EDTA), thallium chloride, thallium nitrate, thallium malonate, arsenious acid, potassium arsenite and the like are exemplified as a crystal growth controlling agent to accelerate deposition rate and improve the surface property of film deposited. The crystal growth controlling agent is added in the range of about 0.1 to about 100 mg/l, preferably about 0.5 to about 50 mg/l as a weight of metal, such as lead, thallium, arsenic and the like.

Amino carboxylates, such as EDTA(ethylenediaminetetraacetic acid), NTA(nitrilo triacetic acid) and the like and aminophosphic acids such as aminotrimethylenephosphonic acid, ethylenediaminetetramethylenephosphonic acid and the like can be exemplified as a stabilizer to improve stability of the plating solution. The amount of stabilizer added is in the range of about 1 to about 80 g/l, preferably about 1 to about 20 g/l. In addition to the stabilizer, oxycarboxylic acids and aromatic oxycarboxylic acids can be used as additives.

A 10 to 35% by weight of hydrogen peroxide is added with an aldehyde or a ketone compound to the present plating solution. The amount of hydrogen peroxide added to the plating solution is in the range of 0.05 to 5 g/l, preferably 0.05 to 1 g/l per a 1 g amount of gold(calculated in terms of metal gold).

The present plating solution is used at temperature in the range of 50° to 90° C., preferably 60° to 75° C. When the concentration of free cyanide ion increases, the concentration of cyanide ion can be maintained in the predetermined range with the addition of an aldehyde or a ketone compound. Known aldehyde or ketone compounds can be generally used as the present aldehyde or ketone compounds added to the plating solution, more concretely the following (1) to (3) can be exemplified:

(1) Aldehyde Compounds straight- or branched-chain saturated aliphatic aldehydes, such as formaldehyde, acetaldehyde, propionaldehyde and the like.

straight- or branched-chain aliphatic dialdehydes, such as glyoxal, succinicdialdehyde and the like.

alicyclic saturated aldehydes, such as cyclohexylaldehyde and the like.

aliphatic unsaturated aldehydes, such as acrolein, crotonaldehyde and the like.

aromatic aldehydes, such as benzaldehyde, salicylaldehyde and the like.

heterocyclic aldehydes, such as furfural, pyridylaldehyde and the like.

(2Ketone Compounds aliphatic saturated ketones, such as acetone, methylethylketone, methylpropylketone and the like.

alicyclic ketones, such as cyclopentanone, cyclohexanone and the like.

aromatic ketones such as acetophenone, propiophenone and the like.

(3) Others ketoaldehydes, such as methylglyoxal and the like.

acid derivatives, such as glyoxylic acid, pyruvic acid, glutalic acid and the like.

hydrogen sulfite additives of the above aldehydes or ketones, such as sodium formaldehyde sulfoxylate.

aldehyde homopolymers, such as paraformaldehyde and the like.

In the above compounds, hydrogen sulfite additives and aldehyde homopolymers are capable of regenerating aldehydes or ketones.

In the compounds mentioned above, preferable aldehyde or ketone compounds are formaldehyde, acetaldehyde, glyoxylic acid, pyruvic acid and paraformaldehyde, more preferable compounds being formaldehyde and paraformaldehyde.

The amount of an added aldehyde or a ketone compound is in the range of about 0.5 to about 50 g, preferably about 1 to about 5 g per a 1 g amount of free cyanide ion (CN—). The addition of an aldehyde or a ketone compound is conducted during plating operation with heat. When added on cooling, the reaction is quickly proceeded by heating.

This invention can maintain the concentration of cyanide ion within a predetermined range without damaging inherent capability of plating solution by converting cyanide ion increasing as the process of plating with the addition of an aldehyde or a ketone compound. Thus, the plating solution can be used in a long term retaining plating rate in a predetermined range and deposited film in a predetermined range in thickness, consequently, an excellent gold plating product can be provided with a low cost.

EXAMPLES

The present invention will be described below in greater detail with examples.

Example 1

As a test plate, a copper plate of 5 cm×5 cm was cleaned in an alkaline condition by dipping the plate in an alkaline soak cleaner (ACE CLEAN A-220 (trademark, product of OKUNO CHEMICAL INDUSTRY Co. Ltd.)) in a concentration of 50 g/l at 60° C. for 5 minutes and then washed with water and dipped in a sulfuric acid solution in a concentration of 10% V/V sulfuric acid at 25° C. for 30 seconds.

After washed with water, the plate was dipped in electroless nickel plating solution (ICP NICORON U (trademark, product of OKUNO CHEMICAL INDUSTRY Co. Ltd.)) at 88° C. for 15 minutes to conduct electroless nickel plating and washed with water, followed by dipped in a 500 ml amount of the electroless plating solution of the following composition at 70° C. for 30 minutes. The pH value of the solution was 13.5.

| constituent | concentration (g/l) |
|---|---|
| $KAu(CN)_2$ | 5.76 |
| KCN | 2.45 |
| NaOH | 20.0 |
| EDTA 2Na | 7.5 |
| EDTA Pb | 0.003 |
| DMAB | 7.8 |

After the test plate was drawn out from the plating solution, the gold concentration of the solution was determined by atomic absorption spectrochemical analysis, and the concentration of DMAB was determined by volumetric analysis.

The above operation was repeated. In the operation, $KAu(CN)_2$ was used as a gold replenishing agent to maintain the gold concentration, and a 11 g of 30% formaldehyde solution was used per 1 g of $KAu(CN)_2$ replenished. In each operation, the amount of deposited gold metal was determined by gravimetry, the deposition rate being calculated using the density of gold(19.3). Further, a 10% of DMAB was added one by one. FIG. 1 (1) indicates that 30 g/l of gold plating can be performed with maintenance of an initial deposition rate.

Example 2

A plating experiment was performed as shown in example 1 except that a 0.5 ml of 35% hydrogen peroxide was further added. The result is shown in FIG. 1 (2).

Example 3

A plating experiment was performed as shown in example 1 except that a 20 g of acetone was added per 1 g replenishment of $KAu(CN)_2$ in place of the formaldehyde solution. The result is shown in FIG. 1 (3).

Example 4

A plating experiment was performed as shown in example 1 except that a 15 g of benzaldehyde was added in place of the formaldehyde solution and that a 0.5 ml of 35% hydrogen peroxide solution was added per 1 g replenishment of $KAu(CN)_2$. The result is shown in FIG. 1 (4).

Example 5

A plating experiment was performed as shown in example 4 except that a 20 g of cyclohexanone was added in place of the benzaldehyde. The result is shown in FIG. 1 (5).

Example 6

The plating experiment was performed as shown in example 1 except that the plating solution (pH 14.0) composed of the following ingredient and that a 20 g of cyclohexanone was added in place of the formaldehyde solution.

| constituent | concentration (g/l) |
|---|---|
| KAu(CN)4 | 7.8 (4 g as Au) |
| KCN | 0.3 |
| KOH | 50.0 |
| ATMP | 3.0 |
| TlNO3 | 0.005 |
| DMAB | 6.0 |

The result is shown in FIG. 1 (7).

Example 7

A plating experiment was performed as shown in example 1 except that a 20 g of acetaldehyde was added per 1 g replenishment of KAu(CN)2 inplace of the formaldehyde solution. The result is shown in FIG. 1 (7).

Comparative Example 1

A plating experiment was performed as shown in example 1 except that formaldehyde was not added and that only KAu(CN)2 and DMAB were replenished. The result is shown in FIG. 1 (6).

Reference Example 1

The concentration of cyanide ion, gold deposition rate and solution stability were determined when formaldehyde was added to the electroless gold plating solution. The results are shown in Table 1. The plating solution was the same solution as shown in example 1. Determination of cyanide ion concentration and gold deposition rate were conducted after the addition of formaldehyde solution and heating the solution at 70° C. for 1 hour.

TABLE 1

| added amount of 30% formaldehyde (g/l) | cyanide ion concentration (g/l) | deposition rate (μm/hr) |
|---|---|---|
| 0 | 2.19 | 3.3 |
| 1 | 1.65 | 4.05 |
| 2 | 1.10 | 4.69 |
| 3 | 0.39 | decomposition |

The results show that the present plating solution using KAu(CN)2 as a gold replenishment source is capable of performing gold plating with maintenance of initial deposition rate and that the solution has an excellent stability.

We claim:

1. A process for electroless gold plating by a continuous plating operation using plating solution comprising cyanoaurate, alkaline cyanide, reducing agent, alkaline hydroxide, crystal condition controlling agent and stabilizer wherein free cyanide ion is converted with the addition of an aldehyde or a ketone compound selected from the group consisting of formaldehyde, acetaldehyde, glyoxylic acid, succinicdialdehyde, cyclohexylaldehyde, acrolein, crotonaldehyde, benzaldehyde, salicylaldehyde, furfural, pyridylaldehyde, acetone, methylethylketone, methylpropylketone, cyclopentanone, cyclohexanone, acetophenone, propiophenone, methylglyoxal, pyruvic acid, glutalic acid, sodium formaldehyde sulfoxylate and paraformaldehyde when the concentration of free cyanide ion increases.

2. The process for electroless gold plating according to claim 1 wherein the aidehyde or ketone compound is water soluble, and hydrogen peroxide is added together with the aidehyde or ketone compound.

3. The process for electroless gold plating according to claim 1 wherein the cyanoaurate is at least one cyanoaurate selected from the group consisting of potassium dicyanoaurate (I), sodium dicyanoaurate (I), potassium tetracyanoaurate (III) and sodium tetracyanoaurate (III).

4. The process for electroless gold plating according to claim 1 wherein alkaline cyanide is used in a concentration in the range of 0.5 to 20 g/l.

5. The process for electroless gold plating according to claim 1 wherein alkaline hydroxide is used in an amount needed to maintain the pH value of the plating solution over 13.

6. The process for electroless gold plating according to claim 1 wherein the crystal condition controlling agent is at least one metal compound selected from the group consisting of lead nitrate, lead oxide, lead acetate, ethylenediaminetetraacetic acid lead salt, thallium chloride, thallium nitrate, thallium malonate, arsenious acid and potassium arsenite.

7. The process for electroless gold plating according to claim 1 wherein the stabilizer is at least one compound selected from the group consisting of ethylendiaminetetraacetic acid, nitrilo triacetic acid, amino trimethylenephosphonic acid and ethylenediaminetetramethylenephosphonic acid and wherein stabilizer is used in the range of 1 to 80 g/l.

8. The process for electroless gold plating according to claim 1 wherein plating solution is used at a temperature in the range of 50° to 90° C.

9. The process for electroless gold plating according to claim 1 wherein an aldehyde or a ketone compound is a compound selected from the group consisting of formaldehyde, acetaldehyde, glyoxylic acid, acetone, cyclohexanone and pyruvic acid.

10. The process for electroless gold plating according to claim 1 wherein the aldehyde or ketone compound is added in the range of 0.5 to 50 g per 1 g of free cyanide ion.

* * * * *